4/1/80 XR 4,195,653

United States Patent [19]

Cessou

[11] 4,195,653

[45] Apr. 1, 1980

[54] METHOD AND APPARATUS FOR RECOVERING PRODUCTS OF LOW PUMPABILITY

[75] Inventor: Maurice Cessou, Communay, France

[73] Assignee: Institut Francais du Petrole, France

[21] Appl. No.: 859,590

[22] Filed: Dec. 12, 1977

[30] Foreign Application Priority Data

Dec. 13, 1976 [FR] France ..... 76 37849
Feb. 17, 1977 [FR] France ..... 77 04584

[51] Int. Cl.[2] ..... B63B 27/24
[52] U.S. Cl. ..... 137/206; 137/13; 137/15; 137/563
[58] Field of Search ..... 137/13, 15, 563, 240, 137/206; 134/5, 24

[56] References Cited

U.S. PATENT DOCUMENTS

| | | | |
|---|---|---|---|
| 2,045,752 | 6/1936 | Butterworth | 134/24 X |
| 3,596,674 | 8/1971 | Takizawa | 137/563 X |
| 3,874,399 | 4/1975 | Ishihara | 137/15 X |

*Primary Examiner*—Alan Cohan
*Attorney, Agent, or Firm*—Craig and Antonelli

[57] ABSTRACT

This method and apparatus comprises displacing the product to be removed from a tank by forming and permanently maintaining at the upper part of the tank, above the product, an aqueous phase filling progressively the tank as the product is removed through a drain pipe. Jets of hot water are introduced into this aqueous phase and a secondary injection is effected in said aqueous phase above the level of these jets.

15 Claims, 8 Drawing Figures

METHOD AND APPARATUS FOR RECOVERING PRODUCTS OF LOW PUMPABILITY

Figure 1:
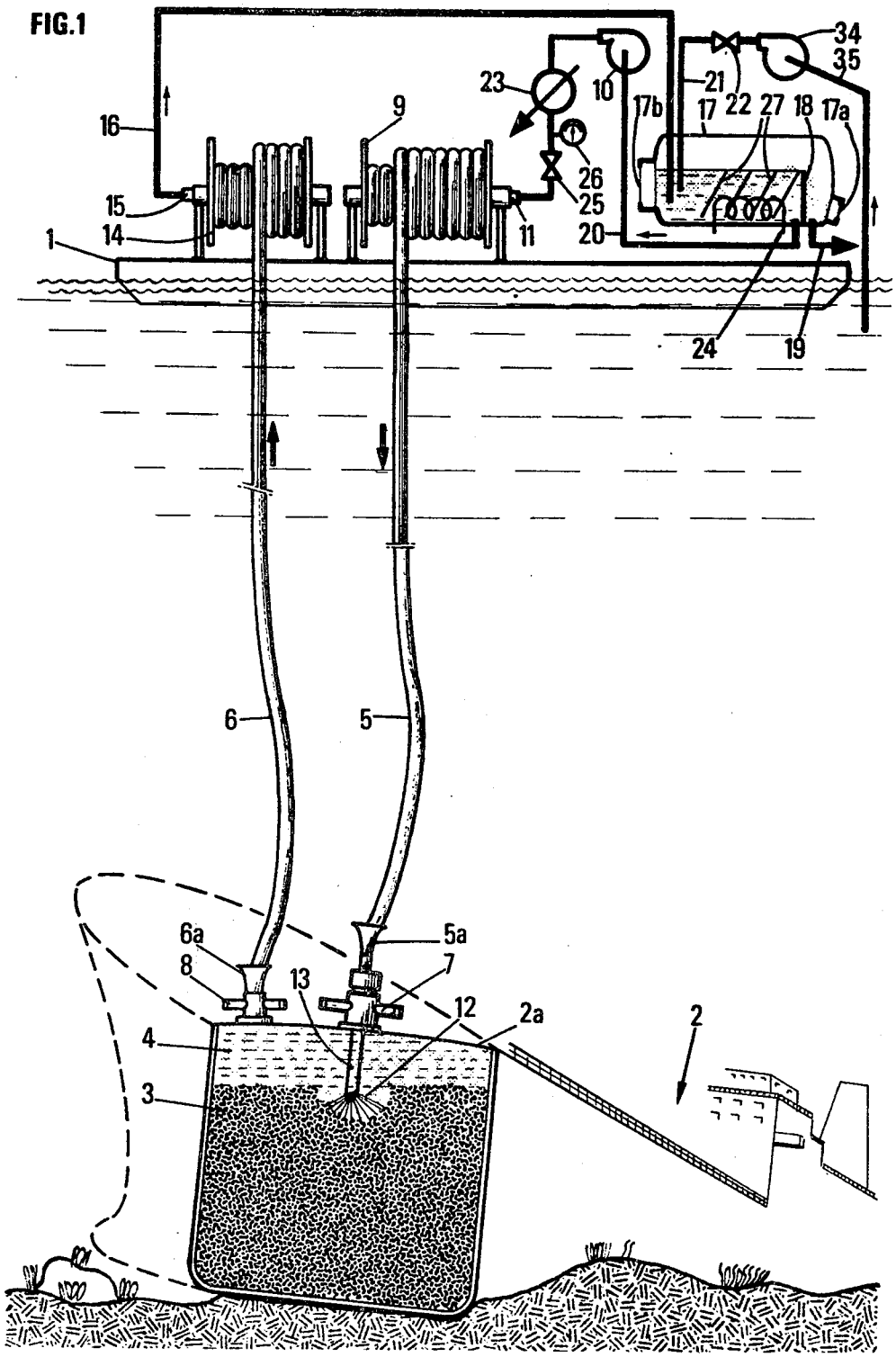

The present invention relates to a method and an apparatus for recovering products of low pumpability.

Reference will be made in the following to a particularly attractive but not limitative application, i.e. removal from the tanks of oil tankers or from the oil tanks of ships, which are stranded or sunken, of hydrocarbons of high viscosity or even practically in the solid state at the temperature of the surrounding medium.

Removal of such hydrocarbons by pumping is very difficult, if not impossible and they subject the surrounding medium to high pollution hazards, because of the risk for the ships of being destroyed, particularly as a result of storms or currents.

More generally the invention may be used for removing products wich are difficult to pump from natural or artificial tanks (subterranean or underwater tanks, tanks located on the ground, as well as floating tanks).

U.S. Pat. No. 3,831,387, in particular, already discloses a method for removing from a tank a product which is difficult to pump, comprising heating water and introducing it into the tank as the product is removed therefrom. This patent specification which contemplates removing the product by submerged pumps, does not describe however sufficiently efficient means for heating the product and reducing its viscosity. Moreover it has been experimentally ascertained that some crude oils are still difficult to pump even when hot.

The invention solves this problem by providing a method for removing from a tank a product difficult to pump which is contained therein, this method comprising connecting to the tank at least one drain pipe, supplying the tank with hot water and discharging the product through said drain pipe as the hot water feeds the tank. This method comprises the step of forming and permanently maintaining an aqueous phase at the upper part of the tank above the product to be removed, by introducing hot water, in the fom of striking and stirring jets, into said aqueous phase located above the product, and discharging the product dispersed in the aqueous phase At the end of the drain pipe opposite to the end connected with the tank, are collected both the water and the product carried along therewith; the product is separated from the water which may be used again, after re-heating thereof, so as to form the jet or jets in the tank.

The hot water jets provide for a good stirring of the aqueous phase in the tank, facilitating heat transfer through convection or conduction, disaggregate the product to be removed and scatter the same in the aqueous phase so as to form a mixture of a low viscosity which can be easily drained off.

The striking and stirring jet or jets will advantageously have a downward vertical component directed towards the interface between the aqueous phase and the product to be removed, being for example inclined by 30° to 40° on the vertical, these values being however non limitative.

Such an arrangement facilitates heat transfer between hot water and the product, as well as the mechanical stripping action of the jets on the product, and produces whirls which tend to rise and drive up the product therewith.

The removal of products of a density lower than 1 which are difficult to pump, is facilitated by draining off the product scattered in water from a point of the tank located above said striking and stirring jet.

According to a particularly preferred embodiment of the invention, the pressure in the tank is kept at a value slightly lower than the pressure of the surrounding medium, to avoid any risk of pollution, by effecting, at the lower end of the drain pipe, at least one secondary injection of hot water, in the direction of discharge of the product, this secondary injection being effected at a level above said striking and stirring jet, into the aqueous phase containing the dispersed product.

Such secondary injection has the additional advantage of reheating the discharge circuit during the starting periods, by mere hot water circulation through this circuit. It also provides for washing or rinsing, with hot water this drain or discharge circuit before disconnecting the same from the tank, thus obviating any risk of pollution of the surrounding medium, which is of particular advantage when discharging tanks at sea.

More generally, it should be noticed that the use in a closed circuit of hot water for displacing the products to be recovered reduces the risks of pollution during tank discharge operations at sea, since the fluid used has substantially the same composition as that of the surrounding medium, which is an advantage as compared to the use of solvents.

Figure 2:
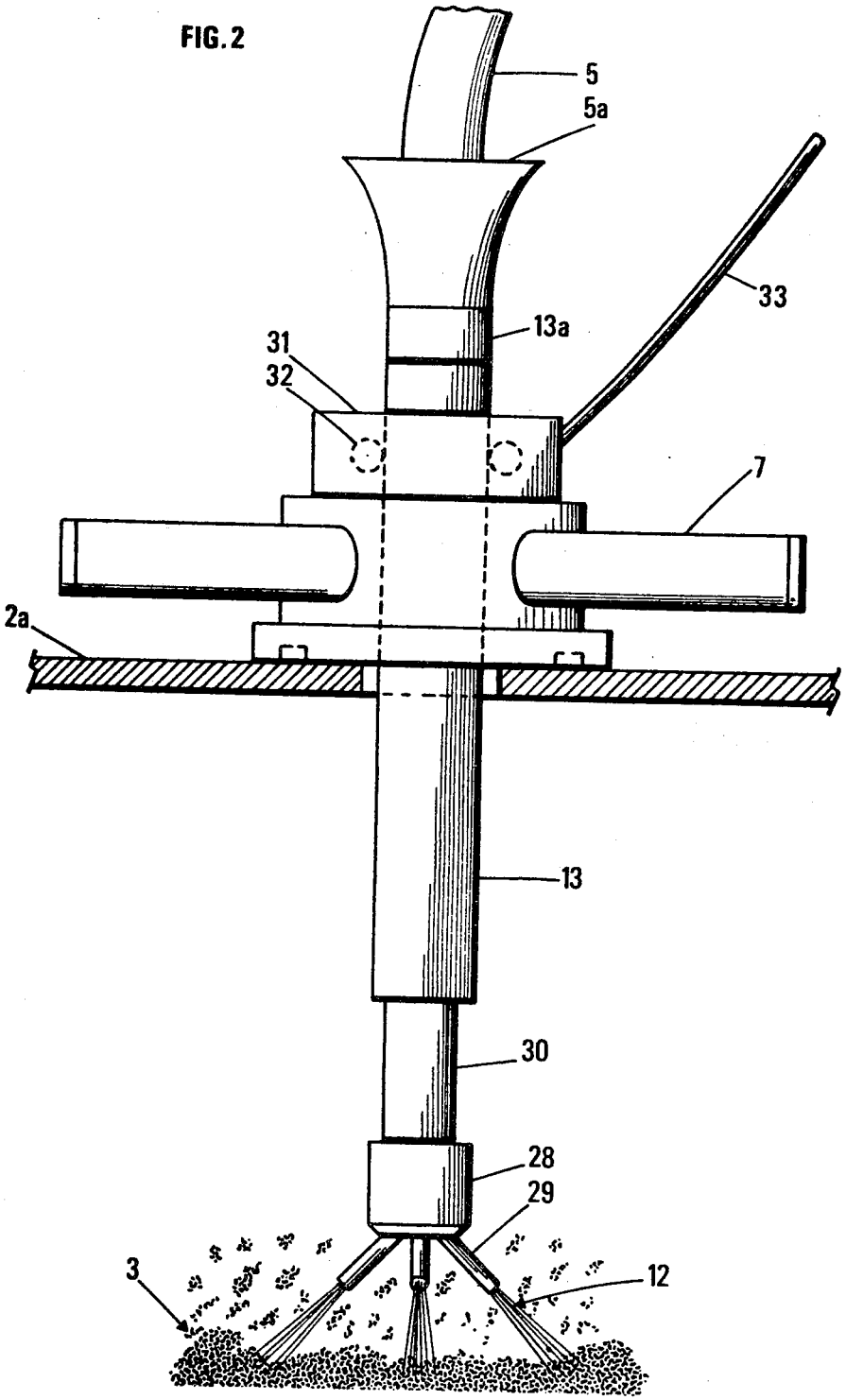
Figures 3, 4:
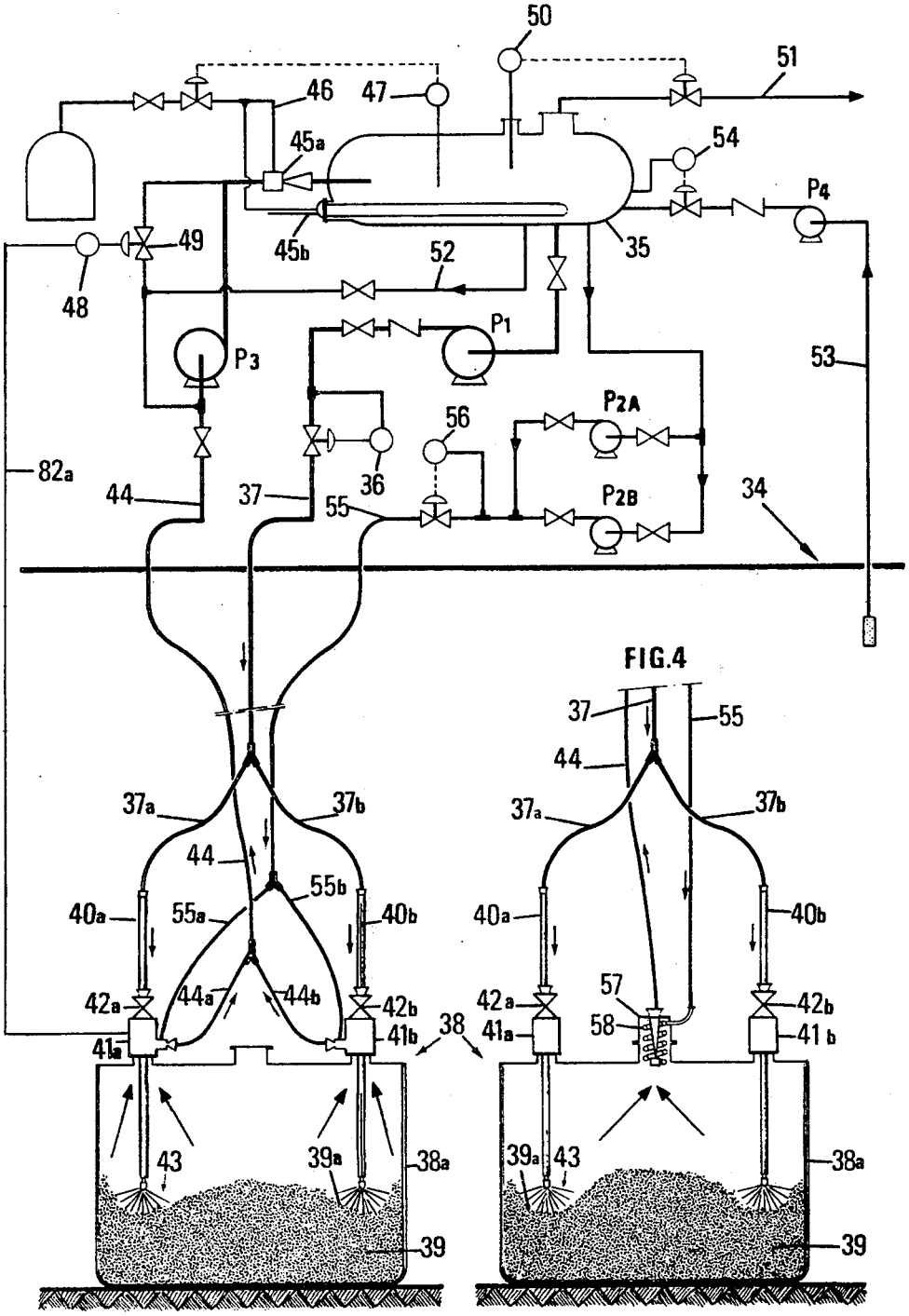
Figure 3A:
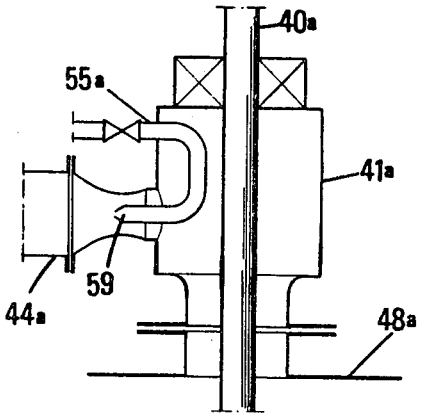
Figure 5A:
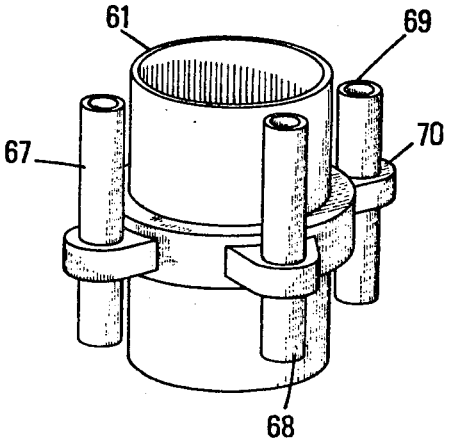
Figure 6:
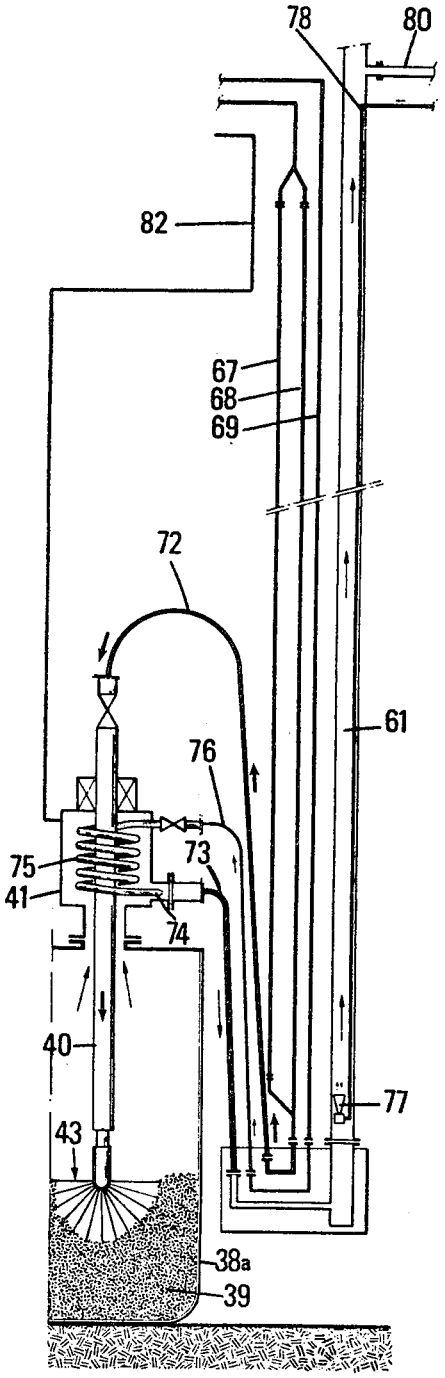
Figure 5:
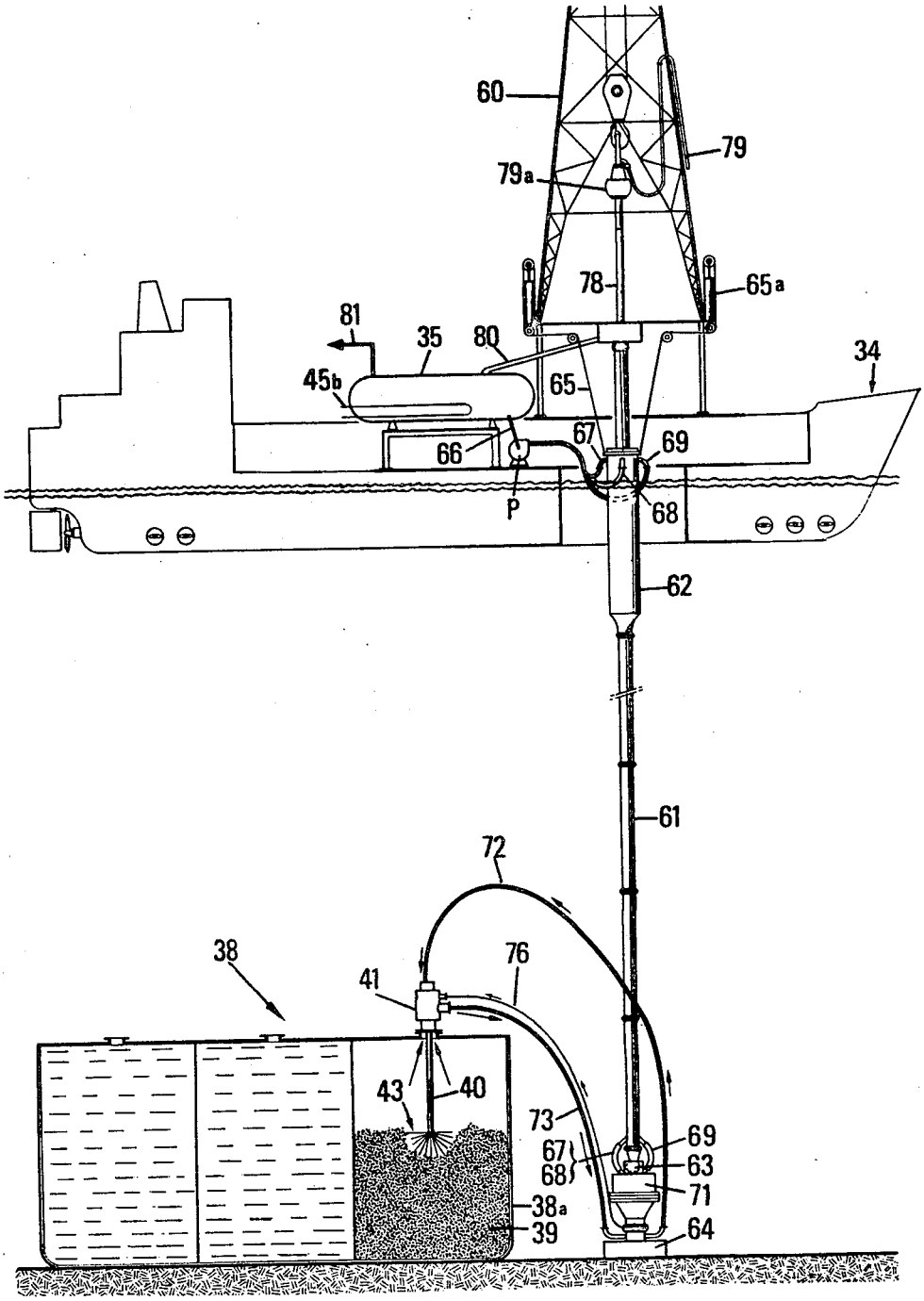

Embodiments of the invention are illustrated by way of example in the accompanying drawings, wherein:

FIG. 1 diagrammatically illustrates an apparatus according to the invention for removing products of low pumpability from a sunken ship, FIG. 2 is a diagrammatic detail view of this apparatus, FIG. 3 diagrammatically shows an embodiment of the present invention, FIG. 3A is a detail view of a connection box, FIG. 4 shows a modification of the preceding embodiement, FIG. 5 illustrates a particular embodiment of use of the invention from a drilling ship, FIG. 5A is a detail view of this embodiment, and FIG. 6 diagrammatically illustrates the assembly of the injection and drain pipes of this last embodiment.

FIG. 1 diagrammatically shows an apparatus according to the invention supported by a specially equipped servicing ship positioned above a sunken ship 2 resting on the water bottom.

The ship is illustrated partially in cross section, the outline of its bow being shown in dotted line.

This ship is assumed to be an oil tanker containing hydrocarbons 3 which are difficult to pump due to their high viscosity at the surrounding temperature, and which should be removed from the ship. Sea water may have entered the tank or tanks containing this mass of very viscous hydrocarbons.

To achieve removal of the hydrocarbons, at least one pair of pipes is connected to the ship tanks, these pipes comprising an injection pipe 5 and a drain pipe 6, using connecting devices 7 and 8 which may be of a known type, secured to the tank wall 2*a*.

In the illustrated embodiments pipes 5 and 6 are in space relationship but they might as well be coaxial.

These pipes will advantageously be flexible, as illustrated, their connection to the tank being effected substantially at the same point thereon, or (as shown) at different locations (for example at the locations of the manholes provided at the top of the tank or tanks).

The outlet pipe 6 will preferably be connected, whenever possible, at the highest point of the tank or tanks, so as to allow complete emptying thereof.

Connection of the pipe can be achieved by divers.

The connectors 7 and 8 secured to the tank can be provided with automatic obturation means, or with safety valves to provide for the tank sealing when the pipes must be raised, for example when the sea conditions oblige to discontinue the operation. Alternatively connectors 7 and 8 may be provided with obturation means which can be electrically or hydraulically closed by remote control from the surface, using remote control lines which may or not be separate from pipes 5 and 6.

Pipe 5 is stored on a reel having a hollow shaft for connection thereto and is fed with pressurized hot water by a pump 10, through a rotary coupling 11 equipping the hollow shaft of the reel. (By "hot water" it is meant here water at a higher temperature than the surrounding temperature prevailing near the water bottom.)

The temperature of the so-supplied hot water may be, for example, comprised between 20° and 100° C. and its discharge pressure at the outlet of pump 10 may reach, for example, several hundreds atmospheres.

At the lower part of pipe 5, this pressurized hot water is delivered through one or more striking and stirring jets in the vicinity of the free surface of the product to be removed. These jets will advantageously have a vertical component directed towards the water-hydrocarbon interface, the inclination of these jets relative to the vertical being, for example, between 30° and 40°.

To this end, pipe 5 is connected to a metal mouthpiece 13, whose length may reach several meters, this mouthpiece traversing connector 7 and being provided with at least one injection nozzle, as hereinunder indicated. Mouthpiece 13 may be equipped with an obturation device 13*a*, either automatic or remotely controlled, for sealing the tank, should pipe 5 be disconnected while mouthpiece 13 is left in position.

Flared elements 5*a* and 6*a* limit respectively the curvature of pipe 5 at its connection with mouthpiece 13 and that of pipe 6 at its connection with connector 8.

Owing to the combined effect of the heat delivered by the injected water and of the mechanical action of the jet or jets, the hydrocarbons 3 are progressively softened, disaggregated and driven along with the carrying fluid, and they rise to the water surface through pipe 6 in the form of water emulsion.

Pipe 6 is stored on reel 14 which also comprises a hollow shaft to which this pipe is connected.

Through a rotary coupling 15 and a pipe 16, the effluent reaches a separation tank 17 wherein water and hydrocarbons are separated from each other.

An overflow system 18 permits the recovery of the hydrocarbons which are drained off through pipe 19 to a storage tank (not shown) as a function of the level followed by a level indicator 17*a*, while the separated water is recycled through pipe 20 to pump 10. A pipe 21, provided with a valve 22 provides for additional fresh water or sea water, as the tank or tanks of the sunken ship are emptied. The whole removal circuit is thereby maintained full of liquid.

This water addition may be effected in the separation tank 17, as illustrated in FIG. 1, or at any other suitable location of the circuit. The amount of additional water depends on the position of the water-hydrocarbon interface, detected by the interface level indicator 17*b*.

Heating of the water may be achieved by a device 23 using a heat-conveying fluid such as, for example, steam, this heating device being located on the water circuit, or/and through a heating coil (electrical heating or heating coil fed with heating fluid), such as those equipping the tanks of an oil tanker, this heating coil being located in the separation tank 17. Alternatively heating may be achieved through direct steam injection into tank 17.

A valve 25 and a pressure gage 26 permit regulation of the flow rate of water injected through pipe 5, and its injection pressure.

In the separation tank 17, the provision of devices 27 of a known type (such as those used in separation tanks of oil refineries), may facilitate coalescence and separation of the hydrocarbons and of the aqueous phase.

FIG. 2 diagrammatically shows the device for injecting hot water into the tank. This device comprises the mouthpiece 13 connected to pipe 5 and traversing connector 7 which is internally provided with annular sealing rings around this mouthpiece.

At the lower part of the mouthpiece is located a stationary or rotary ring 28 provided with one or more nozzles 29 from which is discharged pressurized hot water (jets 12). These nozzles may either be stationary or moveable with respect to ring 28. Suitable means (not shown) hold the mouthpiece in position preventing this mouthpiece from being driven away by reaction, due to the action of the jets.

The optional rotation of ring 28 may be achieved by reaction effect caused by the jets, as in some watering devices, or under the action of a driving motor.

In another embodiment, mouthpiece 13 may be constituted by the stator of a turbine such as that of a turbodrill whose rotor 30, carrying a ring 28 provided with nozzles, will be rotated by pressurized water injected through pipe 5.

The rotary ring 28 and/or nozzles 29 are optionally displaceable in a vertical or transverse direction, so as to facilitate the disaggregation of the hydrocarbon mass.

For example, according to an advantageous embodiment, mouthpiece 13 will be slidably mounted in connector 7, so as to follow the progressive lowering of the free surface of the product to be removed, whenever required.

Downward displacement of mouthpiece 13 may for example be effected by a motor 31 driving rollers 32 pressed against the mouthpiece 13, this motor being energized through line 33 which may also be used for remotely controlling motor 31.

Suitable means may be provided for detecting the level of mouthpiece 13.

In the embodiment diagrammatically illustrated by FIG. 3, sea water which was decanted in the separation tank 35 on board the servicing ship 34 is sucked by pump $P_1$ at the lower part of tank 35 and injected through a flexible or rigid pipe 37 into a tank 38*a* of ship 38 which is stranded or sunken, in the vicinity of the surface 39*a* of the hydrocarbons 39, with flow rate control at 36.

The flexible injection line 37 is divided at its lower part into two pipes 37*a* and 37*b* respectively, which are connected to nozzles or injection mouthpieces 40*a* and 40*b*. These injection nozzles traverse connection boxes 41*a* and 41*b*, connected to the wall 38*a* of ship 38, and wherein they are slidably mounted for vertical displacement. Sealing is ensured by safety elements 42*a* and 42*b* adapted to be closed either automatically upon withdrawal of mouthpieces 40*a* and 40*b* from connection boxes 41*a* and 41*b* (obturator similar to the blow out preventers used in oil wells), or by remote control from the water surface.

The water injected through mouthpieces 40*a* and 40*b* is discharged in the form of striking and stirring jets 43.

This water is at a temperature higher than that of the hydrocarbons in the ship and produces the heating and fluidity increase of these hydrocarbons which rise up through the two branches 44*a* and 44*b* of an outlet pipe 44, in admixture with water, up to a pump $P_3$.

The mixture reaches a separation tank 35. Reheating of the water may be achieved by steam injection into mixer 45*a*, or through a heat exchanger coil 45*b* located in the separation tank 35.

Steam is supplied by pipe 46, with a temperature control at 14, this water providing, through condensation, the heat required for heat-balancing the operation. Through a differential pressure gage 48 connected to tank 38*a* through a line 82*a* and actuating the shunt valve 49 of pump $P_3$ it is possible to prevent, in tank 38*a* of ship 38, any super pressure which might damage it, and to create, on the contrary, in this tank, a slight negative pressure which obviates any risk of leakage towards the surrounding medium and consequently prevents any pollution thereof. Line 82*a* may consist of two flexible pipes, containing a hydraulic fluid, connected to element 48 which adjusts valve 49 in relation with the detected pressure difference.

In this embodiment the separation tank 35 remains full of liquid during the operation so as to avoid disturbances caused by the swell. Hydrocarbons are collected at the lower part of tank 35 wherefrom they can be removed, under control of the interface level at 50, and are discharged through pipe 51 so as to be either transferred into another oil tanker or burnt. The shunt line 52 between the separation tank 35 and the sucking pipe of pump $P_3$ is used to provide, during a determined period after starting the device, a sea water circulation around the heating tank 35 to heat the circuitry.

A sea water addition into tank 35 is supplied by pump $P_4$ through sucking pipe 53, with pressure control at 54, so as to compensate for the amount of hydrocarbons withdrawn from the separation tank so as to keep the system filled up with liquid.

At least one secondary injection of fluid such as heated sea water, is effected into the mixture of water and hydrocarbons which reaches the discharge pipe, by means of one or more devices at least one of which is located as close as possible to the point at which the hydrocarbons are withdrawn from tank 38*a* of ship 38.

In the embodiment illustrated by FIG. 3, this secondary injection is effected by pumps $P_{2A}$ and $P_{2B}$ and by a pipe 55 divided out, at is upper part, into two pipes 55*a* and 55*b* respectively connected to the connection boxes 41*a* and 41*b*, these two pipes ending in an ejector 59, as shown by FIG. 3A.

This secondary injection is effected above the main injection achieved by jets 43, i.e. at a place where the hydrocarbons have already been dispersed in the aqueous phase.

This secondary injection is effected permanently (hence the necessity of two pumps $P_{2A}$ and $P_{2B}$, one of which being an auxiliary pump). Its flow rate is controlled at 56.

The secondary injection has the following advantages:

it permits heating of the discharge pipes 44*a*, 44*b* upon starting the system and keeping these pipes hot enough, even in case of failure of the main pump $P_1$, by jet effect, optionally enhanced by means of a venturi, this secondary injection creates a local negative pressure facilitating suction of the hydrocarbons and their disaggregation upon arrival of a heavy amount of hydrocarbons in the discharge pipes.

This local negative pressure is so adjusted as to permanently maintain in the tank a pressure slightly lower than in the surrounding medium thereby preventing any pollution of this medium.

This secondary injection produces an acceleration of the flow through pipes 44*a*, 44*b*, facilitating the rising of the mixture sea water—hydrocarbons and maintaining in this pipe a sufficient rising velocity, irrespective of the flow rate through pump $P_1$.

These effects of negative pressure and acceleration may also be obtained by one or more complementary injections of liquid or gas (steam or air), through nozzles, in the drain pipe.

In the alternative embodiment illustrated by FIG. 4, the drain pipe 44 and the secondary injection pipe 55 are not sub-divided at their lower part as in the above-embodiment but are both connected to a central connection box 57, the secondary injection pipe for injecting hot water being connected to a heating coil 58 which surrounds the lower end of the drain pipe 44, so as to facilitate reheating thereof and restarting of the system.

Similarly a heating coil may be arranged inside or outside each of connection boxes 41*a* and 41*b* of the above embodiment to perform the same function.

In the embodiment illustrated by FIGS. 5 and 6 a drill ship 34 provided with a derrick 60 is used for removing hydrocarbons 39 contained in a tank 38*a* of ship 38. This drill ship is positioned above ship 38 by any known means, advantageously by using a dynamic positioning system.

A riser pipe 61 of a type conventional in offshore drilling operation, comprising a telescopic coupling 62 absorbing vertical movements due to the heave, is connected at its lower part through a ball joint 63 with a base plate 64 resting on the sea bottom in the immediate vicinity of ship 38. Riser 61 is kept under tension in known manner from the ship 34, using cables 65 connected to tensioning means 65*a*.

Hot sea water injected into tank 38*a* through mouthpiece 40 (jets 43) is drawn from separation tank 35 through pipe 66.

Riser 61 comprises on its periphery, in a conventional manner, three lines 67, 68 and 69 (which are respectively known in the art as kill line, boosting line and choke line) connected to riser 61 through flanges 70, as shown in FIG. 5A.

Pipe 66 for feeding hot sea water is connected with pipes 67 and 68 secured to riser pipe 61 through a group of injection pumps P.

At the lower part of column 61, above a block 71 of blow out preventers, pipes 67 and 68 are connected to main injection pipe 72, itself connected to the injection mouthpiece 40 which is vertically slidable in the connection box 41, as illustrated in FIG. 6.

The connection box is connected to pipe 73 for discharging the hydrocarbon-water mixture, this pipe 73 being connected to the lower part of column 61 (FIG. 6).

An injection of hot water (secondary scavenging injection) is effected at the inlet of pipe 73 through a nozzle 74 located at the end of a heating coil 75, surrounding mouthpiece 40 or connection box 41.

Feeding heating coil 75 with pressurized water is achieved through the third pipe 69 connected to column 61 (FIGS. 5 and 6), this third conduit being supplied with pressurized water through the group of pumps P and being connected at its lower part with heating coil 75 through flexible pipe 76.

It will be optionally possible to adjust by flow rate control means, such as regulators 36 and 56 of FIG. 3, the injection rate through mouthpiece 40 and the secondary scavenging flow rate injected through nozzle 74 (FIG. 6).

According to the preferred, but non limitative, embodiment of the invention illustrated by FIG. 6, it is no longer necessary to make use of a sucking pump, such as pump $P_3$ of FIG. 3 for raising the mixture hydrocarbons-water in column 61. As illustrated, this rising is performed by a hydro-ejector 77, located in column 61, at its lower part, and supplied with pressurized water from the ship, this hydro-ejector producing an upward jet in column 61, and simultaneously creating a negative pressure at the lower part of column 61 and a superpressure at the upper part of column 61, thereby rising the mixture of water and extracted hydrocarbons up to a level above sea water level. This embodiment has the advantage of only requiring the connection to the tank of short pipes, i.e. pipes 72, 73 and 76, thus facilitating the connection and disconnection operations.

The hydro-ejector is advantageously fed with pressurized water through a pipe 78, such as a drill string, located in the column 61 and comprising at its upper part an injection head 79*a*, of conventional design, supported by the hook and the travelling block of the derrick 60. Water injection into the drill stem 78 is carried out in known manner through the injection head 79*a* and a flexible line 79 (FIG. 5) connected to the injection head 79*a* and to pumping means (not shown), such as those conventionally equipping drill ships.

The mixture of hydrocarbons with water rising through column 61 can flow by gravity through a pipe 80 into the separation tank 35, which can be equipped with a heating coil or heat exchanger 45*b*, as in the above-described embodiment.

Tank 35 may be open at its top part and the separated hydrocarbons discharged by overflowing, through pipe 81, and, for example, directed to a flare where they can be burnt.

Additional sea water may be introduced into tank 35, either continuously or intermittently, to compensate for the amount of hydrocarbons discharged from this tank, so that the whole system remains full of liquid. Detection of the interface level 50 (FIG. 3) will be used to control this sea water introduction.

Tank 35 may in some cases be provided with known means (such as those used in the decantation tanks of oil refineries), to facilitate coalescence and separation of the hydrocarbons and of the aqueous phase.

The negative pressure created by the hydro-ejector 77 depends only on the water amount injected through pipe 79, for given flow rates in the main injection pipe 72 and the secondary injection pipe 76.

Regulation of the injection flow rate through pipe 79 can be achieved by means of a differential pressure sensor on the connection pipe 41, which measures the difference between the internal pressure of the box (transmitted for example by a membrane) and the hydrostatic pressure. These pressures are respectively transmitted to the water surface through a connecting line 82 (FIG. 6), for example similar to the connecting line 82*a*, as above described.

It is thus possible to maintain in column 61 a fixed negative pressure, upstream the hydro-ejector 77 and a fixed superpressure downstream this hydro-ejector, irrespective of the flow rates through the main injection pipe 72 and the secondary injection pipe 76. This negative pressure and this superpressure help overcoming pressure drops in the outflow of the water-hydrocarbon mixture, as well as the hydrostatic pressure up to the overflow point of column 61 in pipe 80.

This negative pressure will be fixed at a level so selected as to maintain in tank 38*a* a pressure slightly lower than the hydrostatic pressure at the level of this tank.

As in the above embodiment, it may be advantageous to provide around a separation tank 35, a by-pass pipe, (not shown) whereby a circulation of sea water around this tank can be provided during the starting period of the system, in order to heat the circuitry.

During this starting period, before starting the main water injection through pipes 67, 68, pipe 72 and mouthpiece 40, the interior of the connection box 41 may be heated by pumping hot water through pipe 69, pipe 76 and the heating coil 75. The secondary injection through column 78 and hydro-ejector 77 will also be started.

The main water injection will then be progressively established by initially placing the injection mouthpiece 40 in its uppermost position, to prevent inopportune rising of the heavy hydrocarbon masses into box 41, at the beginning of the operation, this mouthpiece being thereafter progressively lowered.

In operation the scavenging secondary injection through nozzle 74 will make it possible, as in the above embodiments, to disaggregate the hydrocarbon masses reaching the outlet of connexion box 41, since they might otherwise obturate pipe 73.

Suitably calibrated valves are located at various points of the circuit, in particular near the connection box 41 or on this box, to limit any negative pressure or superpressure in tank 38*a*, which might damage this tank and result in an external pollution.

Nozzle 74 may optionally be adapted to create a slight suction effect at the point of connection of this pipe 73 with box 41.

Mouthpiece 40 may advantageously be so designed as to completely obturate the outlet opening of tank 38*a* when it is raised to its uppermost position. There is thus avoided any heavy hydrocarbon rise into box 41, in case of stopping the main injection, or in case of a rapid disconnection of the injection systems.

Before any disconnection, after stopping the discharge of hydrocarbons, a washing with sea water, of the discharge pipes, is normally performed by means of the secondary injection pipes such as 55, 55*a* and 55*b*, or 76, and pipe 78 in the embodiment illustrated by FIG. 6.

What I claim is:

1. An apparatus for withdrawing from a tank a product difficult to pump, comprising at least one drain pipe for the product, equipped with means for connection to the tank, and means for feeding the tank with hot water, wherein said feeding means comprise in combination at least one injection device comprising at least one nozzle for creating at least one striking and stirring hot water jet, this injection device being adapted for connection to the upper part of the tank and being connected with at least one hot water injection pipe, and at least one secondary injection device located in said outlet pipe and oriented in the direction of discharge of the product, this secondary injection device opening in the tank above the level of said nozzle creating said striking and stirring jet.

2. An apparatus according to claim 1, wherein said drain pipe is connected with means for separating from water the product to be removed and means for reheating and recycling the separated water, these recycling means being connected through at least one injection pipe to said device for injecting said striking and stirring hot water.

3. An apparatus according to claim 1, wherein said device for creating said striking and stirring hot water jet is adapted to produce at least one jet having a downward vertical component.

4. An apparatus according to claim 1 wherein said secondary injection device co-operates with a venturi.

5. An apparatus according to claim 1, comprising means for rotating said injection nozzle.

6. An apparatus according to claim 1, comprising means for displacing said injection nozzle by translation.

7. An apparatus according to claim 1, wherein said secondary scavenging injection device surrounds the end of said device creating said striking and stirring jet, to facilitate reheating thereof during the starting period.

8. An apparatus according to claim 1, comprising at least one additional injection pipe for displacing the mixture of water and product to be removed, this additional injection pipe opening through a hydro-ejector into said drain pipe.

9. An apparatus according to claim 1, for discharging from an underwater tank, products which are difficult to pump, wherein said outlet pipe comprises at least one column for raising the products, said column being supported by a surface installation and connected to the tank through a flexible pipe and at least one additional pipe for injection of a driving fluid, said additional pipe opening into said column through a hydro-ejector.

10. An apparatus according to claim 9, wherein said column has secured thereto two water injection pipes connected through flexible pipes respectively to said device creating said striking and stirring jet and to said secondary injection device.

11. An apparatus according to claim 1, comprising safety devices for sealing the tank in case of disconnection of the injection and outlet pipes.

12. An apparatus according to claim 1, comprising antipollution means limiting the difference between the pressure inside the tank and the pressure in the surrounding medium.

13. An apparatus according to claim 3, wherein said secondary injection device co-operates with a venturi.

14. An apparatus according to claim 2, wherein said device for creating said striking and stirring hot water jet is adapted to produce at least one jet having a downward vertical component.

15. An apparatus according to claim 2, wherein said secondary injection device co-operates with a venturi.

* * * * *